US006564886B1

(12) United States Patent
Mensa-Wilmot et al.

(10) Patent No.: US 6,564,886 B1
(45) **Date of Patent: *May 20, 2003**

(54) DRILL BIT WITH ROWS OF CUTTERS MOUNTED TO PRESENT A SERRATED CUTTING EDGE

(75) Inventors: Graham Mensa-Wilmot, Houston, TX (US); Carl W. Keith, Houston, TX (US); Stephen G. Southland, Spring, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/688,569

(22) Filed: Oct. 16, 2000

Related U.S. Application Data

(62) Division of application No. 08/719,929, filed on Sep. 25, 1996, now Pat. No. 6,164,394.

(51) Int. Cl.[7] ..... E21B 10/00; E21B 10/08
(52) U.S. Cl. ..... 175/331; 175/431
(58) Field of Search ..... 175/331, 393, 175/431, 430

(56) References Cited

U.S. PATENT DOCUMENTS

| | | | | | |
|---|---|---|---|---|---|
| 4,512,426 | A | * | 4/1985 | Bidegaray | 175/329 |
| 4,558,753 | A | * | 12/1985 | Barr | 175/329 |
| 4,593,777 | A | * | 6/1986 | Barr | 175/379 |
| 4,705,122 | A | | 11/1987 | Wardley et al. | 175/329 |
| 4,981,184 | A | * | 1/1991 | Knowlton et al. | 175/329 |
| 5,244,039 | A | * | 9/1993 | Newton, Jr. et al. | 175/431 |
| 5,314,033 | A | * | 5/1994 | Tibbitts | 175/431 |
| 5,531,281 | A | * | 7/1996 | Murdock | 175/431 |
| 5,549,171 | A | * | 8/1996 | Mensa-Wilmot et al. | 175/431 |
| 5,558,170 | A | * | 9/1996 | Thigpen et al. | 175/57 |
| 5,582,261 | A | * | 12/1996 | Keith et al. | 175/431 |
| 5,607,025 | A | * | 3/1997 | Mensa-Wilmot et al. | 175/431 |
| 5,671,818 | A | * | 9/1997 | Newton et al. | 175/393 |
| 5,740,874 | A | * | 4/1998 | Matthias | 175/430 |

FOREIGN PATENT DOCUMENTS

| | | | |
|---|---|---|---|
| EP | 0 117 241 | 8/1984 | E21B/10/46 |
| EP | 0 556 648 A1 | 8/1993 | E21B/10/46 |
| GB | 2 282 166 A | 3/1995 | E21B/10/46 |
| GB | 2 292 163 | 2/1996 | E21B/10/46 |
| GB | 2 300 437 A | 11/1996 | E21B/10/46 |

OTHER PUBLICATIONS

UK Search Report dated Dec. 13, 200 for Application No. GB 0028958.7 ((3 p.).

* cited by examiner

*Primary Examiner*—Gary S. Hartmann
(74) *Attorney, Agent, or Firm*—Conley Rose, P.C.

(57) ABSTRACT

A fixed cutter drill bit particularly suited for plastic shale drilling includes rows of cutter elements arranged so that the cutting tips of the cutters in a row are disposed at leading and lagging angular positions so as to define a serrated cutting edge. The angular position of the cutting tips of cutters in a given row may be varied by mounting cutters with different degrees of positive and negative backrake along the same blade. Preferably, within a segment of a given row, the cutters alternate between having positive backrake and negative backrake while the cutters mounted with positive backrake are more exposed to the formation material than those mounted with negative backrake. Nozzles are provided with a highly lateral orientation for efficient cleaning. The positive backrake cutter elements have a dual-radiused cutting face and are mounted so as to have a relief angle relative to the formation material. Cutter elements in different rows are mounted at substantially the same radial position but with different exposure heights, the cutter elements with positive backrake being mounted so as to be more exposed to the formation than those with negative backrake.

14 Claims, 5 Drawing Sheets

DRILL BIT WITH ROWS OF CUTTERS MOUNTED TO PRESENT A SERRATED CUTTING EDGE

RELATED APPLICATIONS

This is a divisional application of U.S. patent application Ser. No. 08/719,929 filed Sep. 25, 1996 now U.S. Pat. No. 6,164,394.

FIELD OF THE INVENTION

The present invention relates generally to fixed cutter drill bits, sometimes called drag bits. More particularly, the invention relates to bits utilizing cutter elements having a cutting face of polycrystalline diamond or other super abrasives. Still more particularly, the invention relates to a cutting structure on a drag bit having particular application in what is often referred to as plastic shale drilling.

BACKGROUND OF THE INVENTION

In drilling a borehole in the earth, such as for the recovery of hydrocarbons or minerals or for other applications, it is conventional practice to connect a drill bit on the lower end of an assembly of drill pipe sections which are connected end-to-end so as to form a "drill string." The drill string is rotated by apparatus that is positioned on a drilling platform located at the surface of the borehole. Such apparatus turns the bit and advances it downwardly, causing the bit to cut through the formation material by either abrasion, fracturing, or shearing action, or through a combination of all such cutting methods. While the bit is rotated, drilling fluid is pumped through the drill string and directed out of the drill bit through nobles that are positioned in the bit face. The drilling fluid is provided to cool the bit and to flush cuttings away from the cutting structure of the bit. The drilling fluid forces the cuttings from the bottom of the borehole and carries them to the surface through the annulus that is formed between the drill string and the borehole.

Many different types of drill bits and bit cutting structures have been developed and found useful in various drilling applications. Such bits include fixed cutter bits and roller cone bits. The types of cutting structures include steel teeth, tungsten carbide inserts ("TCI"), polycrystalline diamond compacts ("PDC's"), and natural diamond. The selection of the appropriate bit and cutting structure for a given application depends upon many factors. One of the most important of these factors is the type of formation that is to be drilled, and more particularly, the hardness of the formation that will be encountered. Another important consideration is the range of hardnesses that will be encountered when drilling through different layers or strata of formation material.

Depending upon formation hardness, certain combinations of the above-described bit types and cutting structures will work more efficiently and effectively against the formation than others. For example, a milled tooth roller cone bit generally drills relatively quickly and effectively in soft formations, such as those typically encountered at shallow depths. By contrast, milled tooth roller cone bits are relatively ineffective in hard rock formations as may be encountered at greater depths. For drilling through such hard formations, roller cone bits having TCI cutting structures have proven to be very effective. For certain hard formations, fixed cutter bits having a natural diamond cutting structure provide the best combination of penetration rate and durability. In formations of soft and medium hardness, fixed cutter bits having a PDC cutting structure are commonly employed.

Drilling a borehole for the recovery of hydrocarbons or minerals is typically very expensive due to the high cost of the equipment and personnel that are required to safely and effectively drill to the desired depth and location. The total drilling cost is proportional to the length of time it takes to drill the borehole. The drilling time, in turn, is greatly affected by the rate of penetration (ROP) of the drill bit and the number of times the drill bit must be changed in the course of drilling. A bit may need to be changed because of wear or breakage, or to substitute a bit that is better able to penetrate a particular formation. Each time the bit is changed, the entire drill string—which may be miles long—must be retrieved from the borehole, section by section. Once the drill string has been retrieved and the new bit installed, the bit must be lowered to the bottom of the borehole on the drill string which must be reconstructed again, section by section. As is thus obvious, this process, known as a "trip" of the drill string, requires considerable time, effort and expense. Accordingly, because drilling cost is so time dependent, it is always desirable to employ drill bits that will drill faster and longer and that are usable over a wider range of differing formation hardnesses.

The length of time that a drill bit may be employed before the drill string must be tripped and the bit changed depends upon the bit's rate of penetration ("ROP"), as well as its durability, that is, its ability to maintain a high or acceptable ROP. In recent years, the PDC bit has become an industry standard for cutting formations of soft and medium hardnesses. The cutter elements used in such bits are formed of extremely hard materials and include a layer of polycrystalline diamond material. In the typical PDC bit, each cutter element or assembly comprises an elongate and generally cylindrical support member which is received and secured in a pocket formed in the surface of the bit body. A disk or tablet-shaped, performed cutting element having a thin, hard cutting layer of polycrystalline diamond is bonded to the exposed end of the support member, which is typically formed of tungsten carbide.

A once common arrangement of the PDC cutting elements was to place them in a spiral configuration along the bit face. More specifically, the cutter elements were placed at selected radial positions with respect to the central axis of the bit, with each element being placed at a slightly more remote radial position than the preceding element. So positioned, the path of all but the center-most elements partly overlapped the path of travel of a preceding cutter element as the bit was rotated.

Although the spiral arrangement was once widely employed, this arrangement of cutter elements was found to wear in a manner to cause the bit to assume a cutting profile that presented a relatively flat and single continuous cutting edge from one element to the next. Not only did this decrease the ROP that the bit could provide, it but also increased the likelihood of bit vibration or instability which can lead to premature wearing or destruction of the cutting elements and a loss of penetration rate. All of these conditions are undesirable. A low ROP increases drilling time and cost, and may necessitate a costly trip of the drill string in order to replace the dull bit with a new bit. Excessive bit vibration will itself dull or damage the bit to an extent that a premature trip of the drill string becomes necessary.

Although PDC bits are widely used, less than desirable performance has sometimes been encountered when drilling through a region of soft shale, usually at great depths or when using drilling fluids having a high specific density (commonly referred to as "heavy" muds). Generally, the poor performance has been noted when drilling in shale formations where the well pressure is substantially high. In such conditions, the ROP of the bit will many times drop dramatically from a desirable ROP to an uneconomical value.

Various theories have been presented in an attempt to explain this phenomena with the hope that, with a better understanding of the drilling conditions, a bit can be designed that will not exhibit the dramatic drop in ROP when such a formation is encountered. One explanation is that the shale in these conditions exhibits a plastic like quality such that the cutter elements depress or deform the formation, but are unable to effectively shear cuttings away from the surrounding material. Another theory holds that the cutter elements are successful in shearing cuttings from the surrounding formation, but due to the nature of the material and current bit designs, the cuttings are not effectively removed from the borehole bottom but instead stick together on the bit face. This phenomena, commonly known as "balling," lessens the ability of the bit to penetrate into the formation, and also impedes the flow of drilling fluid from the nobles, flow that is intended to wash across the bit face and remove such cuttings. Without regard to the various conditions which cause the phenomena, the drastically reduced ROP is a significant problem leading to increased drilling costs and, ultimately, an increase to the consumer in the cost of petroleum products.

Presently, when encountering such plastic shale formations, it has been customary to increase the "weight on bit" (WOB) in an effort to increase the now-reduced ROP. Unfortunately, increasing WOB causes the cuttings which have not yet been successfully cleaned away from the bit face to become compacted on the borehole bottom. These compacted cuttings tend to support the added WOB and lessen the ability of the bit to shear uncut formation material. Further, drilling with an increased or high WOB has other serious consequences and is avoided whenever possible. Increasing the WOB is accomplished by installing additional heavy drill collars on the drill string. This additional weight increases the stress and strain on all drill string components, causes stabilizers to wear more quickly and to work less efficiently, and increases the hydraulic pressure drop in the drill string, requiring the use of higher capacity (and typically higher cost) pumps for circulating the drilling fluid. High WOB also has a detrimental effect on drill string mechanics.

Thus, there remains a need in the art for a fixed cutter drill bit having an improved design that will permit the bit to drill effectively with economical ROPs in plastic shale formations. More specifically, there is a need for a PDC bit which can drill in such shale formations with an aggressive profile so as to maintain a superior ROP while progressing through the formation of the plastic shale so as to lower the drilling costs presently experienced in the industry. Such a bit should provide the desired ROP without having to employ substantial additional WOB and suffering from the costly consequences which arise from drilling with such extra weight. Ideally, the bit would also include a cutting structure that would provide increased durabilty once the bit has advanced through the plastic shale formation and encountered harder and/or more abrasive formations.

SUMMARY OF THE INVENTION

The present invention provides a cutting structure and drill bit particularly suited for drilling through plastic shale formations with normal WOB and without an undesirable reduction in penetration rates. After drilling through such strata of shale, the bit provides the desired durability for drilling through underlying harder formations.

The bit generally includes a bit face with a plurality of radially-spaced cutter elements mounted in a row. At least one row will include first, second and third cutter elements, with the second cutter element being mounted between the first and third cutter elements. The cutter elements in the row are mounted such that the cutting tips of the first and third cutter elements are at leading angular positions relative to the cutting tip of the second cutter element. These cutters with their tips located at differing angular positions relative to the direction of bit rotation define a serrated cutting edge particularly advantageous in drilling of plastic shale.

The serrated cutting edge may be achieved by varying the backrake angles of cutter elements in a row. It is most preferred that the cutter elements along at least a portion of a row alternate between having positive and negative backrake angles. This arrangement staggers the cutting tips of radially adjacent cutter elements such that certain cutting tips lead and others lag relative to the direction of rotation of the drill bit. Advantages are provided by mounting the cutters such that the cutter elements having positive backrake are more exposed to the formation material than the cutter elements in the row that are mounted with negative backrake. This arrangement helps prevent the ribbon-like cuttings formed by closely positioned cutter elements from sticking together on the bit face and reducing ROP.

In one embodiment of the invention, the bit will include a plurality of angularly spaced rows of cutter elements. In this arrangement, the bit includes sets of cutter elements comprised of cutter elements that are located at substantially the same radial position but in different rows. The sets include some cutter elements with positive backrake and others with negative backrake. Preferably, the cutter elements with positive backrake are mounted so as to be more exposed to the formation material while the cutter elements in the same set having negative backrake are less exposed. This provides an aggressive cutting structure for drilling through soft formations and provides the desired durability once harder formations are reached.

The bit further includes flow passages for transmitting drilling fluid from the drill string through the face of the drill bit, and nozzles for directing the fluid flow laterally across each row of cutter elements. The axes of the nozzles are oriented at an angle of at least 45° relative to the bit axis so as to increase the lateral component of the fluid velocity and to sweep the cuttings quickly away from the bit face to prevent balling and the resultant loss of ROP which has plagued the drilling industry in plastic shale formations.

The cutter elements mounted with positive backrake in the present invention include dual radiused cutting faces. The edge of the cutting faces of such cutters have two different curvatures. Those cutter elements are mounted such that the cutting tips are formed on the larger-radiused portion of the cutting edge. Additionally, the cutter elements of the present invention that are most preferred for mounting with a positive backrake include a support member having a cylindrical surface that is mounted with relief from the formation material to enhance the cutter element's durability.

Thus, the present invention comprises a combination of features and advantages which enable it to substantially advance the drill bit art by providing a cutting structure and bit for effectively and efficiently drilling through a formation material that has traditionally hampered and delayed the completion of a borehole and thus substantially increased drilling costs. The bit drills aggressively through plastic shale formation without exhibiting substantial loss in ROP and without requiring the use of undesirable additional WOB. The bit provides the desired durability for the harder formations underneath the plastic shale. These and various other characteristics and advantage of the present invention will be readily apparent to those skilled in the art upon reading the following detailed description of the preferred embodiments of the invention, and by referring to the accompanying drawings.

BRIEF DESCRIPTION OF THE DRAWINGS

For a detailed description of the preferred embodiments of the invention, reference will now be made to the accompanying drawings, wherein:

FIG. 11 is an enlarged elevational view showing an exposure variance between an outside pair of cutters having positive backrake and a middle cutter having negative backrake;

FIG. 12 is an enlarged elevational view in rotated profile of a set of cutters having less than a 30% overlap.

DESCRIPTION OF THE PREFERRED EMBODIMENT

Figure 1:
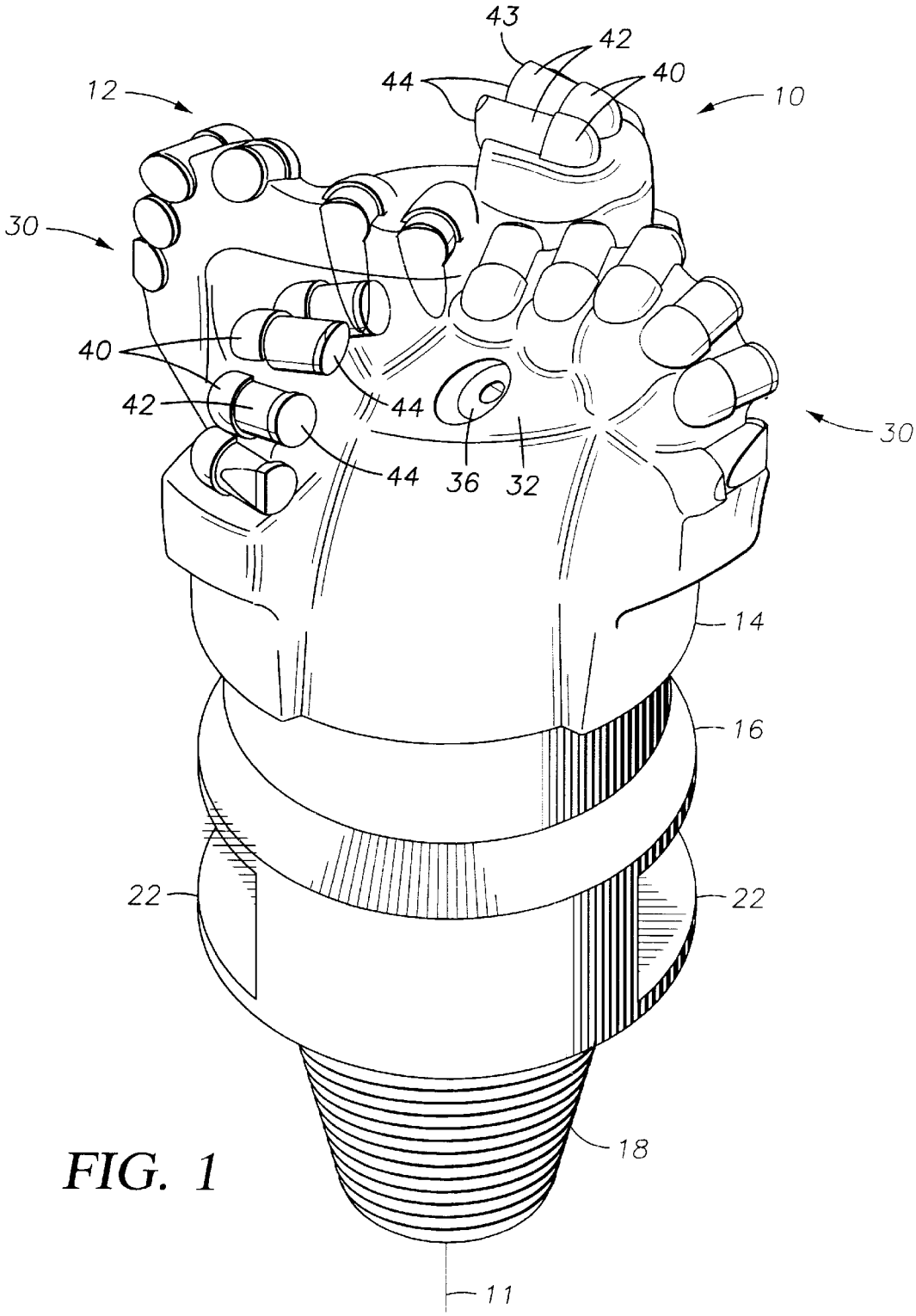
FIG. 1 is a perspective view of a drill bit and cutting structure made in accordance with the present invention.
Figure 2:
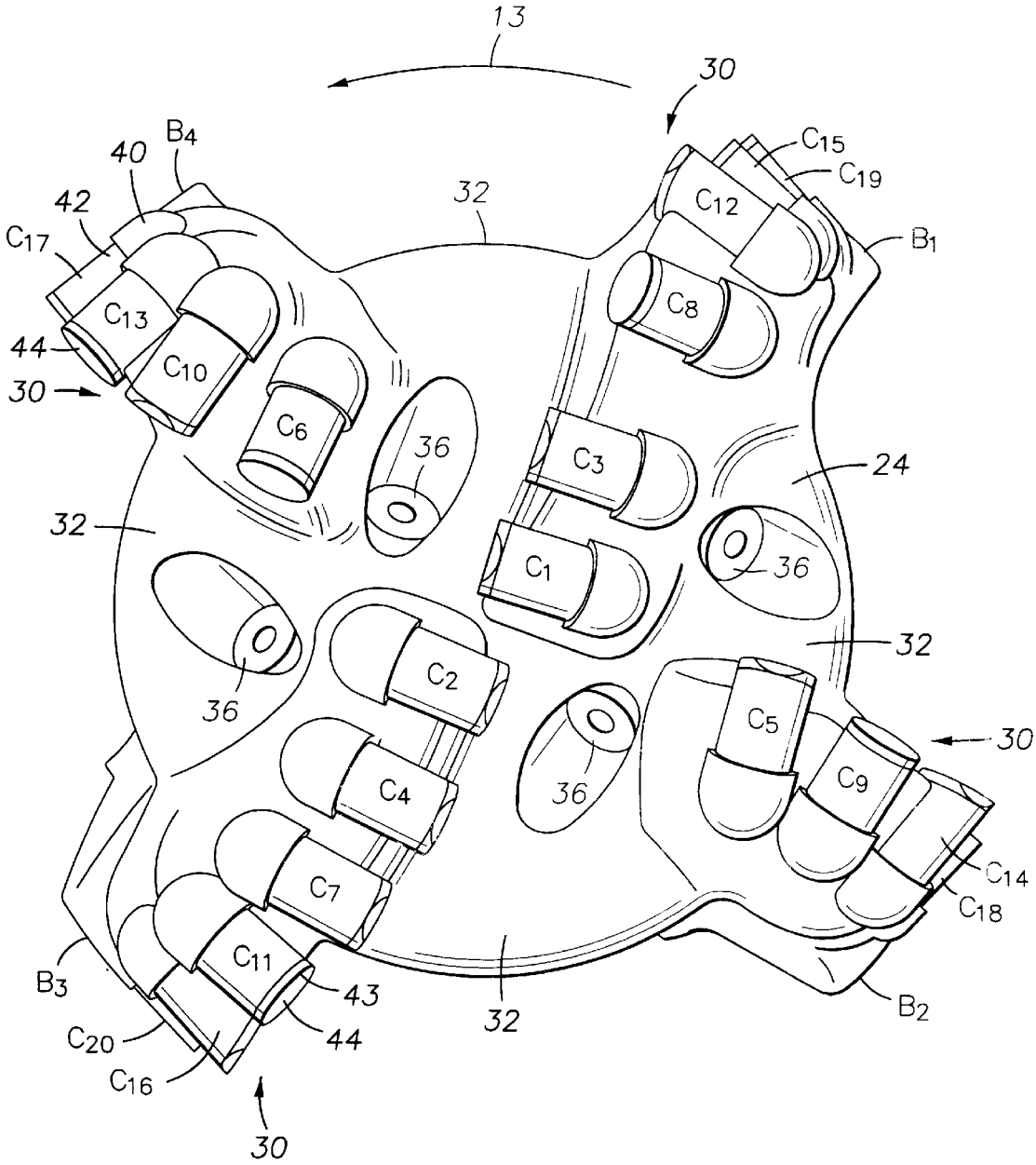
FIG. 2 is a plan view of the cutting face of the drill bit shown in FIG. 1.
Figure 3:
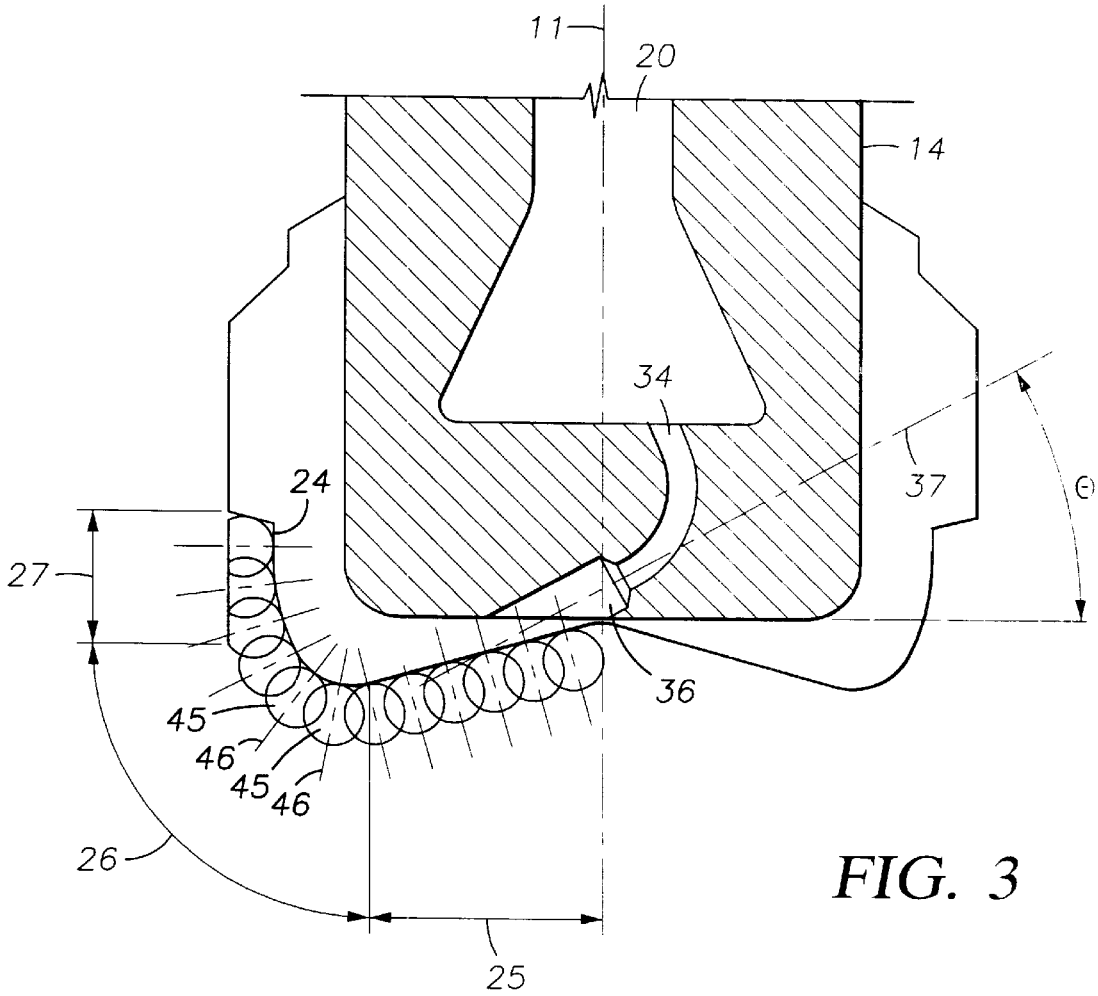
FIG. 3 is an elevational view, partly in cross-section, of the drill bit shown in FIG. 1 with the cutter elements of the bit shown in rotated profile collectively on one side of the central axis of the bit.

A drill bit 10 and PDC cutting structure 12 embodying the features of the present invention are shown in FIGS. 1–3. Bit 10 is a fixed cutter bit, sometimes referred to as a drag bit, and is adapted for drilling through formations of rock to form a borehole. Bit 10 generally includes a central axis 11, bit body 14, shank 16, and threaded connection or pin 18 for connecting bit 10 to a drill string (not shown) which is employed to rotate the bit 10 in order to drill the borehole. A central longitudinal bore 20 (FIG. 3) is provided in bit body 14 to allow drilling fluid to flow from the drill string into the bit. A pair of oppositely positioned wrench flats 22 are formed on the shank 16 and are adapted for fitting a wrench to the bit to apply torque when connecting and disconnecting bit 10 from the drill string.

Bit body 14 also includes a bit face 24 which is formed on the end of the bit 10 that is opposite pin 18 and which supports cutting structure 12. As described in more detail below, cutting structure 12 includes cutter elements $C_1$–$C_{20}$ (FIG. 2) having cutting faces 44 for cutting the formation material. Body 14 is formed in a conventional manner using powdered metal tungsten carbide particles in a binder material to form a hard cast metal matrix. Steel bodied bits, those machined from a steel block rather than manufactured from a formed matrix, may also be employed in the invention. In the embodiment shown, bit face 24 includes four angularly spaced-apart blades $B_1$–$B_4$ which are integrally formed as part of bit body 14. As best shown in FIGS. 1 and 2, blades $B_1$–$B_4$ extend radially across the bit face 24 and longitudinally along a portion of the periphery of the bit. Blades $B_1$–$B_4$ are separated by grooves which define drilling fluid flow courses 32 between and along the cutting faces 44 of the cutter elements $C_1$–$C_{20}$. In the preferred embodiment shown in FIG. 2, blades $B_1$–$B_4$ are not symmetrically positioned, but are angularly spaced apart within the range of about 80–105 degrees.

As best shown in FIG. 3, body 14 is also provided with downwardly extending internal flow passages 34 having nozzles 36 disposed at their lowermost ends. It is preferred that bit 10 include one such flow passage 34 and nozzle 36 for each blade. Thus, the embodiment of FIGS. 1–3 include four passages 34 and nozzles 36 (one of each being shown in FIG. 3). The flow passages 34 are in fluid communication with central bore 20. Together, passages 34 and nozzles 36 serve to distribute drilling fluids around the cutter elements $C_1$–$C_{20}$ for flushing formation cuttings from the bottom of the borehole and away from the cutting faces 44 of cutter elements when drilling. It is important to quickly flush cuttings away from the cutting faces 44 when drilling through plastic shale formations in order to eliminate or minimize "balling," a phenomena that reduces a bit's ROP substantially. Accordingly, the flow passages 34 and nozzles 36 in bit 10 are positioned to direct the fluid flow in a direction more horizontal than vertical in order to increase the horizontal component of the drilling fluid's velocity. The angle $\theta$ between bit axis 11 and the central axis 37 of nozzles 36, measured as shown in FIG. 3, is preferably at least 45°. It is most preferred that the angle $\theta$ be at least 60°. As opposed to typical nozzles and flow passages that direct drilling fluid in a more axial direction toward the borehole bottom, passages 34 and nozzles 36 direct the fluid in a more lateral direction. This arrangement enhances hole cleaning by sweeping the cuttings quickly away from bit face 24.

Referring still to FIG. 3, to aid in an understanding of the more detailed description which follows, bit face 24 may be said to be divided into three portions or regions 25, 26, 27. The most central portion of the bit face 24 is identified by the reference numeral 25 and may be concave as shown. Adjacent central portion 25 is the shoulder or the upturned curved portion 26. Next to shoulder portion 26 is the gage portion 27, which is the portion of the bit face 24 which defines the diameter or gage of the borehole drilled by bit 10. The bit 10 shown in FIGS. 1–3 has a 6 ½ inch diameter, although the principles of the present invention may equally be applied to bits having other diameters. As will be understood by those skilled in the art, the boundaries of regions 25, 26, 27 are not precisely delineated on bit 10, but are instead approximate, and are identified relative to one another for the purpose of better describing the distribution of cutter elements $C_1$–$C_{20}$ over the bit face 24.

Referring to FIGS. 1 and 2, each cutter element C is constructed so as to include a cutting wafer 43 formed of a layer of extremely hard material, preferably a synthetic polycrystalline diamond material that is attached to substrate or support member 42. Wafer 43 is also conventionally known as the "diamond table" of the cutter element C. Polycrystalline cubic boron nitride (PCBN) may also be employed in forming wafer 43. The support member 42 is a generally cylindrical member comprised of a sintered tungsten carbide material having a hardness and resistance to abrasion that is selected so as to be greater than that of the matrix material or steel of bit body 14. One end of each support member 42 is secured within a pocket 40 by brazing or similar means. Wafer 43 is attached to the opposite end of the support member 42 and forms the cutting face 44 of the cutter element C. Such cutter elements C are generally known as polycrystalline diamond compacts, or PDC's. Methods of manufacturing PDC's and synthetic diamond for use in such compacts have long been known. Examples of these methods are described, for example, in U.S. Pat. Nos. 5,007,207, 4,972,637, 4,525,178, 4,036,937, 3,819,814 and 2,947,608, all of which are incorporated herein by this reference. PDC's are commercially available from a number of suppliers including, for example, Smith Sii Megadiamond, Inc., General Electric Company, DeBeers Industrial Diamond Division, or Dennis Tool Company.

Referring still to FIGS. 1 and 2, each cutter element C is mounted within a pocket 40 which is formed in the bit face 24 on one of the radially and longitudinally extending blades $B_1$–$B_4$. The cutter elements C are arranged in separate rows along the blades B–$B_4$ and are positioned along the bit face 24 in the regions previously described as the central region or portion 25, shoulder 26 and gage portion 27. The cutting faces 44 of the cutter elements C are oriented in the direction of rotation 13 of the drill bit 10 so that the cutting face 44 of each cutter element C engages the earth formation as the bit 10 is rotated and forced downwardly through the formation by the drill string.

Figure 4:
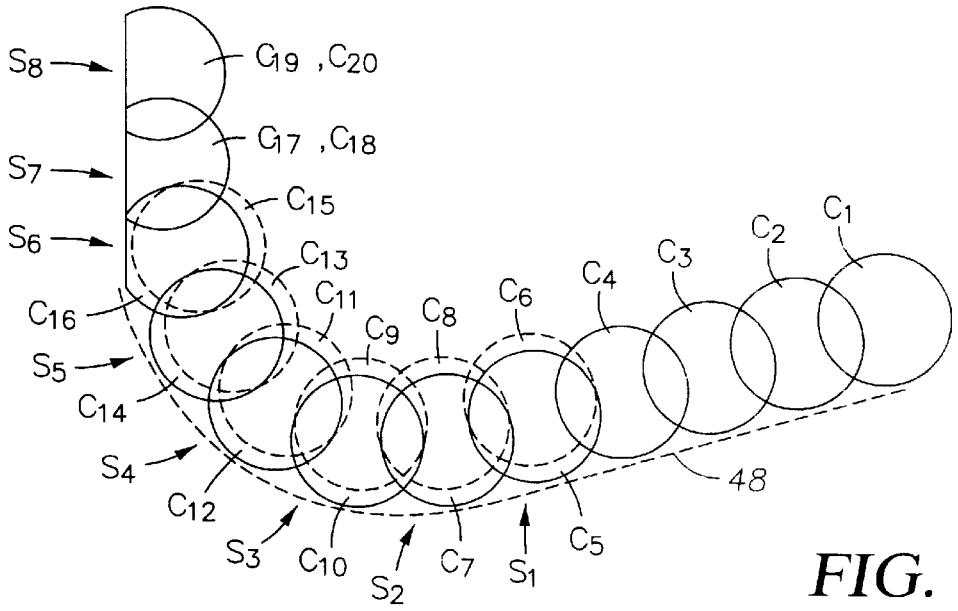
FIG. 4 is an enlarged view showing, schematically, in rotated profile, the relative radial and axial positions of the cutter elements shown in FIGS. 1–3.

Each row 30 of cutter elements C includes a number of cutter elements radially spaced from each other relative to the bit axis 11. As is well known in the art, cutter elements C are radially spaced such that the groove or kerf formed by the cutting profile of a cutter element C overlaps to a degree with kerfs formed by certain cutter elements C of other rows. Such overlap is best understood in a general sense by referring to FIGS. 3 and 4 which schematically shows, in rotated profile, the relative radial positions of the cutter elements C–$C_{20}$. The cutting faces 44 of cutter elements $C_1$–$C_{20}$ are depicted in FIGS. 3 and 4 in rotated profile collectively on one side of bit axis 11. As shown in FIG. 3, the cutter element axes 46 are normal to bit face 24 and bisect the cutting profiles of cutting faces 44.

Referring now to FIGS. 2 and 4, elements $C_1$ and $C_3$ are radially spaced in a first row 30 on blade $B_1$ (along with cutter elements $C_8$, $C_{12}$, $C_{15}$ and $C_{19}$). As bit 10 is rotated, elements $C_1$ and $C_3$ will cut separate grooves or kerfs in the formation material, leaving a ridge between those kerfs. As the bit 10 continues to rotate, cutter element $C_2$, mounted on blade $B_3$ will sweep across the bottom of the borehole and cut the ridge that is left between the kerfs made by cutter elements $C_1$ and $C_3$. Likewise, given its radial positioning, element $C_3$ on blade $B_1$ will cut the ridge between the kerfs that are formed by elements $C_2$ and $C_4$ on blade $B_3$. With this radial overlap of cutter element profiles along the bit face 24, the bit cutting profile may be generally represented by the relatively smooth curve 48 (FIG. 4) defined by the outermost edges or cutting tips 45 of cutting faces 44. Cutting tips 45 are the points on the edge of the cutting face 44 that are the most exposed to the formation material.

In addition to being mounted in rows 30, certain of the cutter elements C are arranged in sets S which comprise cutter elements from various rows 30 that have the same or substantially the same radial position with respect to bit axis 11. Sets S may include 2, 3 or any greater number of cutter elements C. In the preferred embodiment thus described and depicted, bit 10 includes sets $S_1$–$S_8$, with each set including two cutter elements that are mounted on different blades $B_1$–$B_4$.

As will be understood by those skilled in the art, certain cutter elements C, although angularly spaced apart, are positioned on the bit face 24 at the same radial position and mounted at the same exposure height relative to the formation. As used herein, such elements are referred to as "redundant" cutters. As thus defined, a redundant cutter element will follow in the same swath or kerf that is cut by another cutter element. In the rotated profile of FIGS. 3 and 4, the distinction between such redundant cutter elements cannot be seen; however, in the present embodiment of the invention, cutter elements $C_{18}$ and $C_{17}$ are redundant and define cutter element set $S_7$. Likewise, cutter elements $C_{20}$ and $C_{19}$ are redundant and define set $S_8$.

Referring still to FIG. 4, the cutter elements $C_5$–$C_{16}$ positioned along the shoulder portion of bit face 24 are arranged in sets $S_1$–$S_6$. The cutter elements within each set $S_1$–$S_6$ are mounted so as to have varying degrees of exposure to the formation material. More specifically, cutter elements $C_5$, $C_7$, $C_{10}$, $C_{12}$, $C_{14}$, $C_{16}$ are positioned so that their cutting tips 45 extend to the bit cutting profile 48 and thus extend slightly farther from bit face 24 and thus deeper into the formation than the cutting tips of cutter elements $C_6$, $C_8$, $C_9$, $C_{11}$, $C_{13}$, $C_{15}$ which extend to positions just short of cutting profile 48. In this arrangement, cutter elements $C_5$, $C_7$, $C_{10}$, $C_{12}$, $C_{14}$ and $C_{16}$ are thus more exposed to the formation material than are cutter elements $C_6$, $C_8$, $C_9$, $C_{11}$, $C_{13}$ and $C_{15}$. In the 6 ½ inch bit 10 thus described, the exposure height between cutters $C_5$ and $C_6$ of set $S_1$ differs by approximately 0.040 inch. The different in the height of cutter tips of cutter elements in a set may be referred to as the "exposure variance." The exposure variance for the cutter pairs in sets $S_2$ and $S_3$ is approximately 0.040 inch. Moving toward the gage portion 27 of the bit, the exposure variance decreases such that, for example, the exposure variance for cutter pairs in sets $S_4$ is approximately 0.020. The variance between cutters $C_{13}$ and $C_{14}$ is approximately 0.015 and the exposure variance between cutters in set $S_6$ is approximately 0.005 inch.

The cutter elements $C_1$–$C_{20}$ shown in FIGS. 3 and 4 are mounted with their element axes 46 aligned and normal to bit face 24. Because the bit face 24 is curved, and because the axes 46 of the cutter elements C in each set $S_1$–$S_6$ are aligned and normal to the bit face 24, the cutter elements in sets $S_1$–$S_6$ do not have exactly the same radial position relative to bit axis 11. Nevertheless, because cutter elements C in each set $S_1$–$S_6$ cut in the same circular path, the elements in the same set may fairly be said to have substantially the same or a common radial position.

As bit 10 is rotated about its axis 11, the blades $B_1$–$B_4$ sweep around the bottom of the borehole causing the more exposed cutter elements of each set $S_1$–$S_6$ to each cut a trough or kerf within the formation material. The more exposed cutter elements C in each set $S_1$–$S_6$, at least before significant wear occurs, cut deeper swaths or kerfs in the formation material than the less exposed cutter elements in the set. The less exposed cutter elements in sets $S_1$–$S_6$ follow in kerfs cut by the more exposed elements, but are not called upon to cut a significant volume of formation material given that they are less exposed or partially "hidden" by the more exposed elements.

When bit 10 having a cutter arrangement shown in FIG. 4 is first placed in a borehole, it has the characteristics of a light set bit due to the fact that the lesser exposed elements perform very little cutting function. In relatively soft formations, the bit will drill with very little wear experienced by any of the cutter elements C. As formation material penetrated by the bit 10 becomes harder, the more exposed elements will begin to wear. Eventually, the more exposed elements will wear to the extent that the previously "hidden" elements will begin to cut substantially equal volumes of formation material. At this point, the previously hidden elements will be subjected. to substantial loading like the previously more exposed elements, and bit 10 will have the characteristics of a heavy set bit as is desirable for cutting in harder formations.

Figure 5:
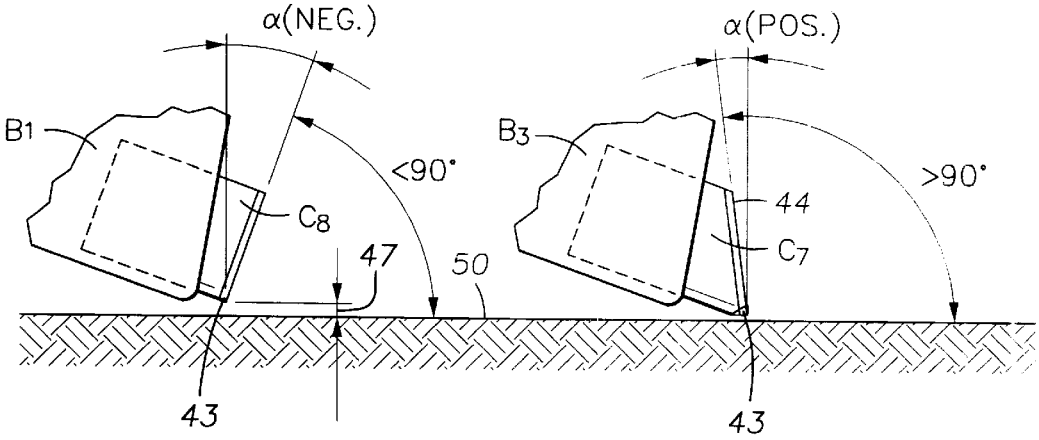
FIG. 5 is a schematic profile view showing certain of the cutter elements shown in FIG. 4 engaging formation material at various degrees of backrake.

In the preferred embodiment of the invention, bit 10 will include cutter elements C having differing backrake angles within sets S. For example, referring to FIG. 5, cutter element $C_7$ of set $S_2$ is shown having a positive backrake angle $\alpha_{POS}$, meaning that cutting face 44 meets the formation material at an angle that is greater than 90° (an angle of 90° being equal to zero backrake). As blade $B_3$ with cutter element $C_7$ sweeps along the borehole bottom, cutter element $C_7$ will cut a kerf in the formation material, the bottom of which is identified by reference numeral 50. As explained above, the lesser exposed cutter element $C_8$, mounted on blade $B_1$, tracks in the kerf formed by cutter element $C_7$. After cutter element $C_7$ has worn to the extent that the exposure variance 47 becomes zero such that cutter elements $C_7$ and $C_8$ are both cutting to the same depth, cutter element $C_8$ will engage the formation material. As shown, cutting face 44 of cutter element $C_8$ will engage to formation at an angle that is less than 90°. Thus, according to conventional nomenclature, cutter element $C_8$ is mounted with negative backrake as defined by $\alpha_{NEG}$.

Figure 6:
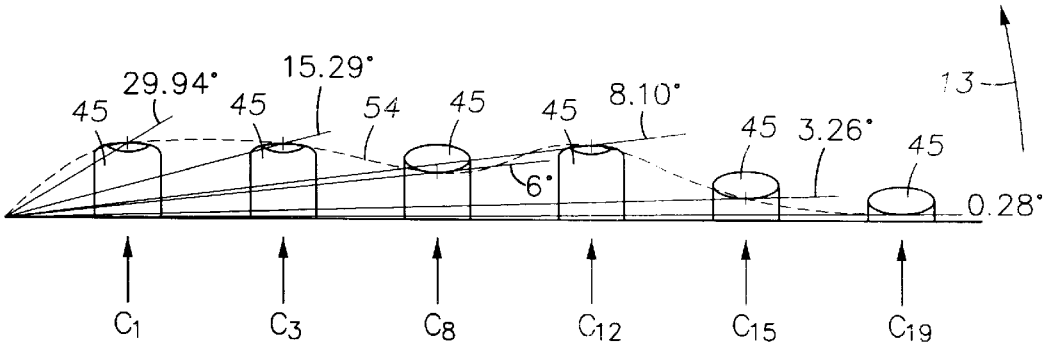
FIG. 6 shows, in schematic form, the relative angular position of the cutting tips of the cutter elements of one of the blades of the bit shown in FIG. 1.

It is also preferred that the backrake angles of cutter elements C within each row 30 be varied, and that the backrake angles of adjacent cutters in the row alternate between positive and negative backrake. Varying the backrake angles $\alpha$ of the cutter elements C in rows 30 provides substantial advantages when drilling through soft formations at great depths or with heavy muds, formations frequently referred to as plastic shale. Referring now to FIG. 6, it can be seen that the angular position of cutting tips 45 of cutter element $C_1$, $C_3$, $C_8$, $C_{12}$, $C_{15}$ and $C_{19}$ of blade $B_1$ differ. Upon moving radially outward along row 30 of blade $B_1$ and comparing the relative angular position of cutting tips 45, it can be seen that the angular positions of the cutting tips 45 oscillate or alternate between leading and lagging positions relative to the direction of rotation 13 of bit 10. For example, cutter element $C_3$ having a positive backrake angle is mounted on blade $B_1$ such that its cutting tip 45 is located at an angular position of 15.29° measured from a reference position for blade $B_1$ of zero degrees. By contrast, radially adjacent cutter element $C_8$, with a negative backrake angle, is mounted having its cutting tip 45 located at an angular position of 6° measured from the same reference position. The next adjacent cutter element $C_{12}$ with a positive backrake angle has a more forwardly positioned cutting tip 45 relative to the cutting tip of cutter element $C_8$ and is located at an angular position of 8.1°. Thus, cutting tips 45 of cutter elements $C_3$ and $C_{12}$ are at leading angular positions relative to the angular position of the cutting tip 45 of cutter element $C_8$. Cutter element $C_{15}$ with a negative backrake angle has a cutting tip 45 located at an angular position of 3.26°.

In this manner, it can be seen that the cutting tips 45 of cutter elements $C_3$, $C_8$, $C_{12}$, $C_{15}$ are staggered relative to one another. In this arrangement, as blade $B_1$ rotates in the borehole, the cutting tips 45 of cutter elements $C_3$, $C_8$, $C_{12}$, $C_{15}$ present a serrated cutting edge or blade front to the formation material. Similarly, blades $B_2$–$B_4$ which also include cutter elements with positive and negative backrakes, likewise present serrated cutting edges. Additionally, cutter elements $C_3$, $C_8$ and $C_{12}$, which comprise the cutter elements along one segment of row 30 on blade $B_1$, vary in exposure height as best shown in FIG. 4. As shown, the cutter elements $C_3$ and $C_{12}$ have cutting tips that extend fully to cutting profile 48 and are thus more exposed to the formation material than the cutting tip of cutter element $C_8$ which is recessed relative to cutting profile 48. It is believed that staggering the cutting tips 45 of the cutter elements along the blades $B_1$–$B_4$ and varying the exposure height of the cutter elements along the blades significantly contributes to the ability of bit 10 to drill through plastic shale formations and avoid the significant loss of ROP experienced with conventional bits. A bit made in accordance with the principles of the invention will preferably include at least one cutter element C with cutting tip 45 at a first angular position mounted between two other cutter elements that are mounted on the same blade and which have cutting tips 45 at more forward angular positions so as to create the sawtooth or serrated blade cutting edge 54 that is intended to be achieved by this invention. Preferably the cutter elements on the blade will also alternate in exposure height. This arrangement tends to minimize the tendency for the ribbon-like cuttings created by adjacent cutter elements to stick or clump together on the bit face 24. By so mounting the cutter elements in a row along a blade so as to have alternating leading and lagging cutting tips and alternating exposure heights, the likelihood of ribbon-like cuttings from radially adjacent cutter elements combining together is lessened. Also, the highly lateral orientation of the nozzles 36 and the resultant flow of drilling fluid substantially along the cutting faces 44 of the cutter elements C of a given blade enhance bit 10's ability to resist balling and to maintain acceptable ROP, even in soft, plastic shale formations.

In the preferred embodiment thus described, the serrated cutting edges 54 of blades $B_1$–$B_4$ was achieved by alternating the cutter elements C in a row 30 between cutter elements having positive backrake angles and cutter elements having negative backrake angles. In that embodiment, it is preferred that $\alpha_{POS}$ be approximately 10° positive backrake and that $\alpha_{NEG}$ be approximately 20° negative backrake; however, other values for $\alpha_{POS}$ and $\alpha_{NEG}$ may be employed in the invention. For example, $\alpha_{POS}$ may be within the range of 5–60°, although 10–40° is presently preferred. Likewise, $\alpha_{NEG}$ may be within the range of 5–50°, although 10–40° is preferred.

To a lesser degree, a serrated edge 54 may be created along a blade by mounting cutter elements C on the blade B with all positive backrake angles, but by changing the amount of the positive backrake between adjacent cutter elements in the row. Similarly, the serrated blade cutting edge 54 can be achieved by using cutter elements C on a blade B having negative backrake angles, and by varying that angle between adjacent cutter elements along the blade.

Thus, in one embodiment of the invention, a bit may have a plurality of cutter elements with all positive backrake angles in a row on a first blade and another plurality of cutter elements with all negative backrake angles in a row on a second blade that follows behind or lags the first blade. Nevertheless, the embodiment shown in FIGS. 1, 2 and 6 is presently most preferred as it allows the loading on blades $B_1$–$B_4$ to be optimally divided, and provides the desired combination of aggressiveness (as provided by positive backrake cutters) and durability (provided by cutter elements having negative backrake angle). A bit having cutter elements with all positive backrake angles, might tend to be too aggressive and dull to quickly in certain formations. Similarly, a bit having its cutter elements all with negative backrakes, may not exhibit the aggressiveness and ROP desired in certain formations.

Although cutter elements with positive backrake may be configured and constructed in a variety of ways, the preferred embodiment for the cutter elements with positive backrakes as used in the present invention have features and characteristics particularly advantageous for drilling in plastic shale formations. These features are best understood with reference to FIGS. 7 and 8 where cutter elements $C_1$ is shown, it being understood that cutter elements $C_5$, $C_7$, $C_{10}$, $C_{12}$, $C_{14}$, and $C_{16}$ are substantially identical to cutter elements $C_1$.

Figure 7:
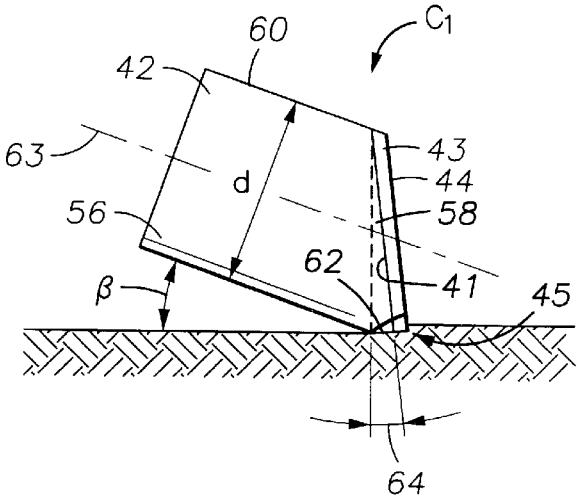
FIG. 7 is a side elevation view of the preferred embodiment of one of the cutter elements employed in the bit and cutting structure shown in FIG. 1.

As shown in FIG. 7, cutter element $C_1$ includes polycrystalline diamond wafer 43 and support member 42. Support member 42 includes base portion 56 and transition portion 58. Base 56 is a generally cylindrical member having a diameter d, a cylindrical outer surface 60, and a central longitudinal axis 63. Transition portion 58 is integrally formed with base 56 and is generally wedge-shaped in cross section as shown in FIG. 7. Transition portion 58 includes an outer curved surface 62 which extends between wafer 43 and cylindrical surface 60 of base 56. In profile, surface 62 meets cutting face 44 at an angle substantially equal to 90°. So configured, cutter element $C_1$ has a five-sided side profile. In the preferred embodiments shown, diameter d of base 56 is approximately 0.5 inch. The length of transition portion 58 measured along surface 62 at its widest point 64 (the distance as measured between the trailing or back side 41 of wafer 43 and the intersection of transition portion 58 with the cylindrical surface 60 of base 56) should be relatively short for cutter elements to be mounted with positive backrake, and in the embodiment shown, is approximately 0.020 inch.

Figure 8:
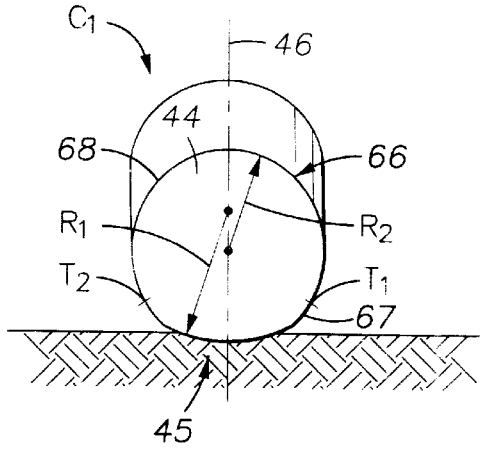
FIG. 8 is a front elevation view of the cutter element shown in FIG. 7.

Referring to FIG. 8, cutting face 44 includes a cutting edge 66 along the perimeter of face 44. Cutting edge 66 includes transition points $T_1$ and $T_2$. The segment 67 of cutting edge 66 between points $T_1$ and $T_2$ that includes cutting tip 45 and that is most exposed to the formation material has a first curvature that is defined by radius $R_1$. The portion 68 of cutting edge 66 that extends between transition points $T_1$ and $T_2$ and that is furthest from the formation material is characterized by having a radius $R_2$, where $R_2$ is less than $R_1$. In the preferred embodiment, $R_1$ is equal to 0.75 inch and $R_2$ is equal to 0.5 inch. Given the configuration thus described in which the cutting face 44 has two different curvatures along its edge, cutting face 44 is fairly described and referred to as a dual-radiused cutting face. Because the portion 67 of cutting edge 66 has a larger radius than portion 68, the curvature of edge portion 67 is less than the curvature of edge segment 68.

Referring again to FIG. 7, substrate 42 is mounted in blade $B_1$ (not shown in FIG. 7) such that the edge of cylindrical surface 60 of base 56 forms a relief angle β with the formation material. In the present invention, β should be between 5 and 20 degrees and, most preferably, is approximately 15°. Providing such relief between the substrate 42 and the formation material increases the drilling efficiency of the cutter element $C_1$. When cutter $C_1$ is mounted as shown in FIG. 7 and is cutting formation material, surface 62 of transition portion 58 enhances the cutter's durability by increasing the ability of the diamond wafer 43 to survive impact loading. Despite a lack of relief for surface 62, providing transition portion 58 on cutter $C_1$ is nevertheless advantageous as it provides additional strength and support for cutting tip 45.

Figure 9:
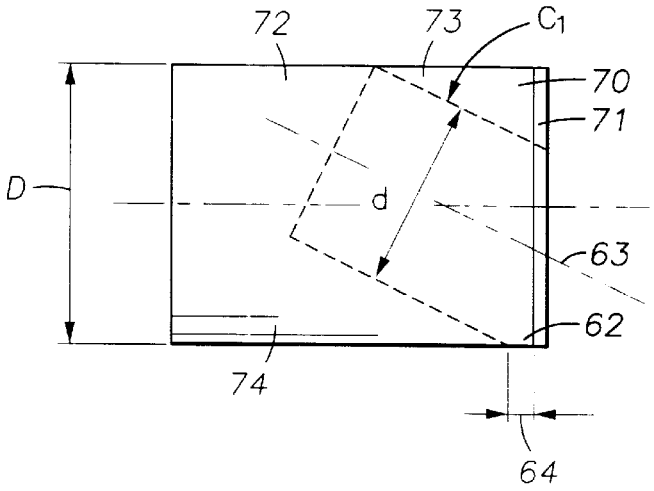
FIG. 9 is a side elevation view of a cutter element from which the cutter element shown in FIG. 7 may be manufactured.

Cutter element $C_1$ is preferably machined from a larger diameter cutter element 70 as shown in FIG. 9. Cutter element 70 includes a polycrystalline diamond wafer 71 and a cylindrical support member 72 having a diameter D which is greater than the diameter d of base 56 of support member 42 of cutter element $C_1$. To manufacture cutter element $C_1$ in this manner, portions 73 and 74 are ground or otherwise machined away from member 72, leaving cutter element $C_1$. Cutter element 70 thus forms the stock from which cutter element $C_1$ is made. By removing portions 73 and 74 from cutter element 70, cutter element $C_1$ is formed with a positive backrake and with a dual radiused cutting face. As will be understood, a portion of cutting edge 66 on cutting face 44 that is most exposed to the formation material and which includes cutting tip 45 thus has a radius that is equal to the radius of the cutting face of the cutter element 70. At the same time, however, cutter element $C_1$ has a smaller overall diameter d than cutter element 70 which is advantageous as small diameter cutter elements are less prone to breakage and improve durability of the bit. Additionally, machining cutter element $C_1$ from a larger cutter element 70 provides manufacturing advantages, in that cutter elements 70 found to have certain defects may nevertheless be salvaged and used to form cutter elements such as $C_1$. Cutter element $C_1$ having a dual radiused cutting face and positive backrake angle may also be formed by conventional pressing techniques. Shorter versions of cutter elements $C_1$ can also be formed or cut and thereafter bonded to a longer substrate by known processes to increase the cutter's length.

Figure 10:
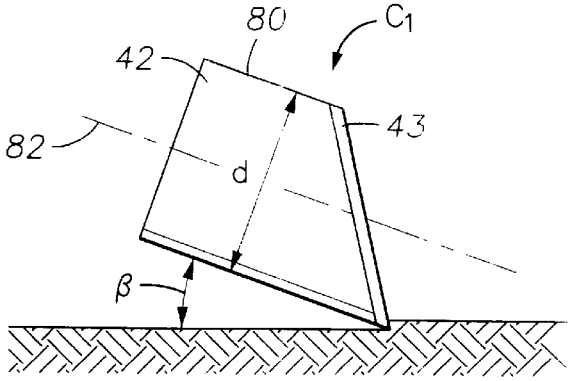
FIG. 10 is a side elevation view of an alternative embodiment of a cutter element for use in the bit and cutting structure shown in FIG. 1.

An alternative embodiment for cutter element $C_1$ is shown in FIG. 10. Cutter element $C_1'$ includes support member 42 having a diameter d, a cylindrical outer surface 80 and a central longitudinal axis 82. As shown, cutter element $C_1'$ is similar to cutter element $C_1$ previously described with reference to FIG. 7 except that cutter element $C_1'$ in FIG. 10 does not include a transition portion 58 having a curved surface 62 that engages the formation material. Instead, the entire substrate or support member 42 is relieved and does not contact the formation material, the angle of relief denoted as relief angle β. The cutter element $C_1'$ may be made from a larger cylindrical cutter element 70 such as that shown in FIG. 9 and preferably would have a dual radiused cutting face as previously described and shown in FIG. 8.

FIG. 11 is a schematic view of three cutting elements. First cutting element 121 and third cutting element 123 have a positive backrake angle. Second cutting element 122 has a negative backrake angle. The second cutting element is mounted between the first and third cutting elements 121, 123. In addition, the first cutting element 121 and third cutting element 123 are mounted to be more exposed to the formation than the second cutting element 122.

FIG. 12 is a rotated profile view of a set of cutters 101–103, 105–106 having less than a 30% overlap.

While the preferred embodiments of the invention have been shown and described, modifications thereof can be made by one skilled in the art without departing from the spirit and teachings of the invention. The embodiments described herein are exemplary only, and are not limiting. Many variations and modifications of the invention and the principles disclosed herein are possible and are within the scope of the invention. Accordingly, the scope of protection is not limited by the described set out above, but is only limited by the claims which follow, that scope including all equivalents of the claimed subject matter.

What is claimed is:

1. A drill bit having a central axis for drilling a borehole in formation material comprising:

a bit body having a bit face and a first plurality of radially-spaced cutter elements disposed on said bit face in a first row, said first row including at least a first and a third cutter element mounted with cutting faces having a positive backrake angle and a second cutter element mounted with a cutting face having a negative backrake angle, said second cutter element being mounted in said first row between said first and third cutter elements, wherein said first and third cutter elements are mounted to be more exposed to the formation material than said second cutter element.

2. A drill bit according to claim 1 further comprising:

a second plurality of radially-spaced cutter elements disposed on said bit face in a second row, said second row including at least a fourth and a sixth cutter element with cutting faces having a negative backrake angle and a fifth cutter element with a cutting face having a positive backrake angle, said fifth cutter element being mounted in said second row between said fourth and sixth cutter elements, wherein said first and fourth cutter elements are mounted at a first radial position, said second and fifth cutter elements are mounted at a second radial position, and said third and sixth cutter elements are mounted at a third radial position.

3. The drill bit of claim 2 wherein said positive backrake angles of said first, third and fifth cutter element are between 5 and 60 degrees.

4. The drill bit of claim 1 wherein said first cutter element has a dual-radiused cutting face.

5. The drill bit of claim 1, wherein said area of overlap does not create a relatively flat cutting edge from one cutter to an overlapping cutter.

6. The drill bit of claim 1 wherein said cutting face of said first cutter element has an edge with a first segment of a first curvature and a second segment of a second curvature that is less than said first curvature, and wherein said cutting tip of said first cutter element is positioned on said second segment.

7. The drill bit of claim 1 further comprising:

a fluid flow passage formed in said bit body for conducting drilling fluid through said bit face;

a nozzle in said flow passage for directing drilling fluid toward said cutter elements in said first row, said nozzle having a central axis;

wherein said nozzle is mounted such that said central axis of said nozzle is at an angle of at least 45 degrees with respect to said bit axis.

8. A drill bit having a central axis for drilling a borehole in formation material comprising:

a bit body having a bit face and a plurality of blades for rotation in a predetermined direction of rotation about the bit axis;

a plurality of cutter elements mounted on said blades and having cutting faces with cutting tips for engaging the formation material, said cutting tips of said cutter elements on a given one of said blades defining a cutting edge of said given blade;

radially-spaced sets of cutter elements, wherein said sets comprise at least a first and a second cutter element mounted on different blades at substantially the same radial position relative to the bit axis; and wherein said cutter elements on said given blade are mounted in differing angular positions relative to said direction of rotation and define a serrated cutting edge on said given blade, and further wherein said first cutter element is mounted on said bit face with a positive backrake angle and said second cutter element is mounted on said bit face with a negative backrake angle and wherein said cutting tip of said first cutter element is disposed at a leading angular position relative to said cutting tip of said second cutter element.

9. The drill bit of claim 8 further comprising a nozzle in said bit face for directing a flow of drilling fluid along said cutting edge of said given blade, said nozzle having a central axis and being mounted such that said nozzle axis forms an angle with said bit axis of at least 45 degrees.

10. The drill bit of claim 8 wherein said first cutter element includes a cutting face attached to a support member having a cylindrical outer surface, and wherein said first cutter element is mounted such that said cylindrical outer surface has an angle of relief of at least 5 degrees.

11. The drill bit of claim 8 wherein said first cutter element includes a support member with a generally cylindrical surface mounted on said bit face with a relief angle between the formation material and said cylindrical surface of at least 5 degrees.

12. A cutting structure for a fixed cutter drill bit having a central axis comprising:

a first cutter element at a first radial position having a cutting face with positive backrake;

a second cutter element at a second radial position more distant than said first radial position having a cutting face with negative backrake;

a third cutter element at a third radial position more distant than said second radial position having a cutting face with positive backrake;

a fourth cutter element at a radial position substantially the same as said first radial position having a cutting face with negative backrake;

a fifth cutter element at a radial position substantially the same as said second radial position having a cutting face with positive backrake;

a sixth cutter element at a radial position substantially the same as said third radial position having a cutting face with negative backrake.

13. The cutting structure of claim 12 further comprising a leading blade and a lagging blade that is angularly spaced from said leading blade, wherein said first, second and third cutter elements are mounted on said leading blade and said fourth, fifth and sixth cutter elements are mounted on said lagging blade.

14. The drill bit of claim 12, wherein said second cutter overlaps with a different cutter in rotated profile by at most about 30%.

* * * * *